US007810852B2

(12) United States Patent
Alacqua et al.

(10) Patent No.: US 7,810,852 B2
(45) Date of Patent: Oct. 12, 2010

(54) MANUAL ACTUATING SYSTEM ASSISTED BY A SHAPE-MEMORY ACTUATOR

(75) Inventors: Stefano Alacqua, Orbassano (IT); Gianluca Capretti, Orbassano (IT)

(73) Assignee: C.R.F. Societa Consortile per Azioni, Orbassano (Torino) (IT)

( * ) Notice: Subject to any disclaimer, the term of this patent is extended or adjusted under 35 U.S.C. 154(b) by 259 days.

(21) Appl. No.: 11/687,174

(22) Filed: Mar. 16, 2007

(65) Prior Publication Data

US 2007/0215445 A1 Sep. 20, 2007

(30) Foreign Application Priority Data

Mar. 16, 2006 (EP) ..... 06425177

(51) Int. Cl.
*E05C 3/06* (2006.01)
*E05C 1/06* (2006.01)

(52) U.S. Cl. ..... 292/201; 292/144; 292/DIG. 66

(58) Field of Classification Search ..... 292/144, 292/201, DIG. 66
See application file for complete search history.

(56) References Cited

U.S. PATENT DOCUMENTS

| | | | | |
|---|---|---|---|---|
| 4,806,815 | A * | 2/1989 | Honma | 310/307 |
| 5,977,858 | A * | 11/1999 | Morgen et al. | 337/140 |
| 6,008,992 | A * | 12/1999 | Kawakami | 361/726 |
| 6,310,411 | B1 * | 10/2001 | Viallet | 307/125 |
| 6,732,516 | B2 * | 5/2004 | Butera et al. | 60/527 |
| 6,762,669 | B2 * | 7/2004 | Alacqua et al. | 337/140 |
| 6,835,083 | B1 * | 12/2004 | Alacqua et al. | 439/310 |
| 6,871,519 | B2 * | 3/2005 | Butera et al. | 70/256 |
| 7,086,885 | B2 * | 8/2006 | Alacqua | 439/266 |
| 7,097,212 | B2 * | 8/2006 | Willats et al. | 292/1 |
| 7,406,846 | B2 * | 8/2008 | Chu | 70/278.7 |

FOREIGN PATENT DOCUMENTS

| | | | |
|---|---|---|---|
| EP | 1 245 762 | B1 | 2/2002 |
| EP | 1279784 | A1 * | 1/2003 |
| EP | 1 245 762 | B2 | 1/2004 |
| EP | 1 399 793 | B1 | 9/2005 |
| EP | 1 598 568 | A1 | 11/2005 |
| GB | 2021265 | * | 11/1979 |
| WO | WO03/003137 | | 1/2003 |

OTHER PUBLICATIONS

European Search Report for EP 06425177.0 dated Sep. 20, 2006.

* cited by examiner

*Primary Examiner*—Carlos Lugo
(74) *Attorney, Agent, or Firm*—Heslin Rothenberg Farley & Mesiti P.C.; Victor A. Cardona, Esq.

(57) ABSTRACT

An assisted manual actuating device includes a controlled member, which can be displaced from a first position into a second position, a control member, which is designed to actuate the controlled member, and a mechanical transmission, which connects the control member to the controlled member. The mechanical transmission includes a shape-memory element, which is supplied by an electrical-supply that can be activated when the control member reaches an actuation position. The assisted manual actuating device includes an activation device having an anchor for constraining the mechanical transmission when the control member reaches the actuation position of the device in such a way as to enable the mechanical transmission to move only in the direction useful for bringing the controlled member into the second position.

13 Claims, 5 Drawing Sheets

MANUAL ACTUATING SYSTEM ASSISTED BY A SHAPE-MEMORY ACTUATOR

CROSS REFERENCE TO RELATED APPLICATIONS

This application claims priority from European patent application No. EP06425177.0, filed on Mar. 16, 2006, the entire disclosure of which is incorporated herein by reference.

BACKGROUND OF THE INVENTION

The present invention relates to actuating devices of the type comprising:

a controlled member that can be displaced from a first position into a second position, said first position corresponding to a resting position of the actuator;

a control member designed to actuate said controlled member, said control member being guided manually along a first actuation travel to reach an actuation position of the actuator;

a mechanical transmission that connects said control member to said controlled member, said mechanical transmission comprising a shape-memory element; and electrical-supply means for supplying a current through said shape-memory element, said means being activated when said control member reaches said actuation position.

Shape-memory actuator (SMA) elements have been known from some time and used in a wide range of fields in which it is necessary to have available actuator means of a simple structure and of low cost. They use shape-memory metal alloys which can undergo deformation when a pre-set transition temperature is exceeded. In general, heating can be obtained in so far as the actuator element detects directly a variable environmental temperature, or else by supplying an electric current through the actuator element so as to heat it by the Joule effect.

In this case, the electrical-supply means can also be associated to electronic control means designed to control the current supply on the basis of a signal detected by a temperature sensor, by a position or displacement sensor, or else by a potentiometer.

Actuator devices of this type are, for example, used to provide manual-control actuation on motor vehicles, for example for actuating mobile parts or mechanisms of motor-vehicle seats, or for actuating mobile members of the engine or of services on board the motor vehicle.

The document No. EP 1 245 762 filed in the name of the holder of the present patent application describes a lock controlled via a control member. If said control member is brought into the actuation position, it activates electrical-supply means, which conduct a current through a shape-memory element constituted by a wire. Said wire is heated by the Joule effect and shortens in such a way as to open the lock.

A drawback of this actuating device lies in the fact that, when the shape-memory element is activated, this, by shortening, generates forces, in the direction of its length, which tend to bring the two ends of the wire closer to one another. Consequently, at the end connected to the control member a force is generated, which tends to displace the control member from the actuation position into the initial resting position. The user will then have to exert a force such as to cause the controlled member to remain in said actuation position. Even though the values of the forces involved are relatively small, this activation is in any case inconvenient for a user above all in the case where he does not expect any countering action.

SUMMARY OF THE INVENTION

The purpose of the present invention is to solve the above drawback and in particular to provide an actuator in which the user can choose to issue a command for the actuating device in an altogether servo-assisted way or else in an altogether mechanical way.

The present invention is in any case of general application, even outside the automotive field, to any sector where it may be useful to utilize an assisted manual actuating device.

With a view to achieving said purpose, the subject of the invention is an actuating device of the type indicated above, characterized in that, when the control member is brought into the actuation position, the mechanical transmission is constrained via an anchoring means in such a way as to be able to move only to bring said controlled member into said second position.

In the embodiment of the present invention, the control member can perform a first actuation travel and a second actuation travel. A user gets the control member to perform the first actuation travel, in this way activating the shape-memory element. At this point the SMA element, while remaining in the actuation position reached following the first travel, electrically actuates the device. In the case, instead, where the user gets the control element to follow also the second actuation travel, the shape-memory element is deactivated, and at the same time mechanical actuation of the device takes place.

Consequently, thanks to the aforesaid characteristics, as has already been indicated above, the device according to the invention can be used either as simple mechanical transmission element or as servo-assisted transmission element proper.

In either mode of actuation, associated to the control member are elastic means, which recall it towards a resting position.

BRIEF DESCRIPTION OF THE DRAWINGS

Further characteristics and advantages of the invention will emerge from the ensuing description with reference to the annexed plate of drawings, which are provided purely by way of non-limiting example, and in which.

DETAILED DESCRIPTION OF THE INVENTION

With reference to FIGS. 1-4, the reference number 10 designates the assisted manual actuating device connected to a locking device S for a motor vehicle.

A mechanical transmission 1 is connected at a first end 1*a* to the control element (for example, a handle M) and at a second end 1*b* to the controlled element, in this case the lock S.

The mechanical transmission 1 comprises a shape-memory actuator A, which in the example illustrated is of the type described in the document No. EP 1 399 793 filed in the name of the present applicant. As described in detail in the aforesaid document, the aforesaid actuator has a flexible wire made of shape-memory material set within a sheath. These two elements are constrained to a first end body and to a second end body of the actuator in such a way that, when the actuator is used as simple mechanical-transmission element, it is sufficient to exert a pulling action on one of the two end bodies in so far as said pulling action is transmitted by means of the aforesaid sheath to the opposite end body of the actuator. In said operating mode, the shape-memory flexible wire is not subjected to stresses in so far as all the tensile stress is transmitted through the sheath from one end to the other of the actuator.

Figure 1:
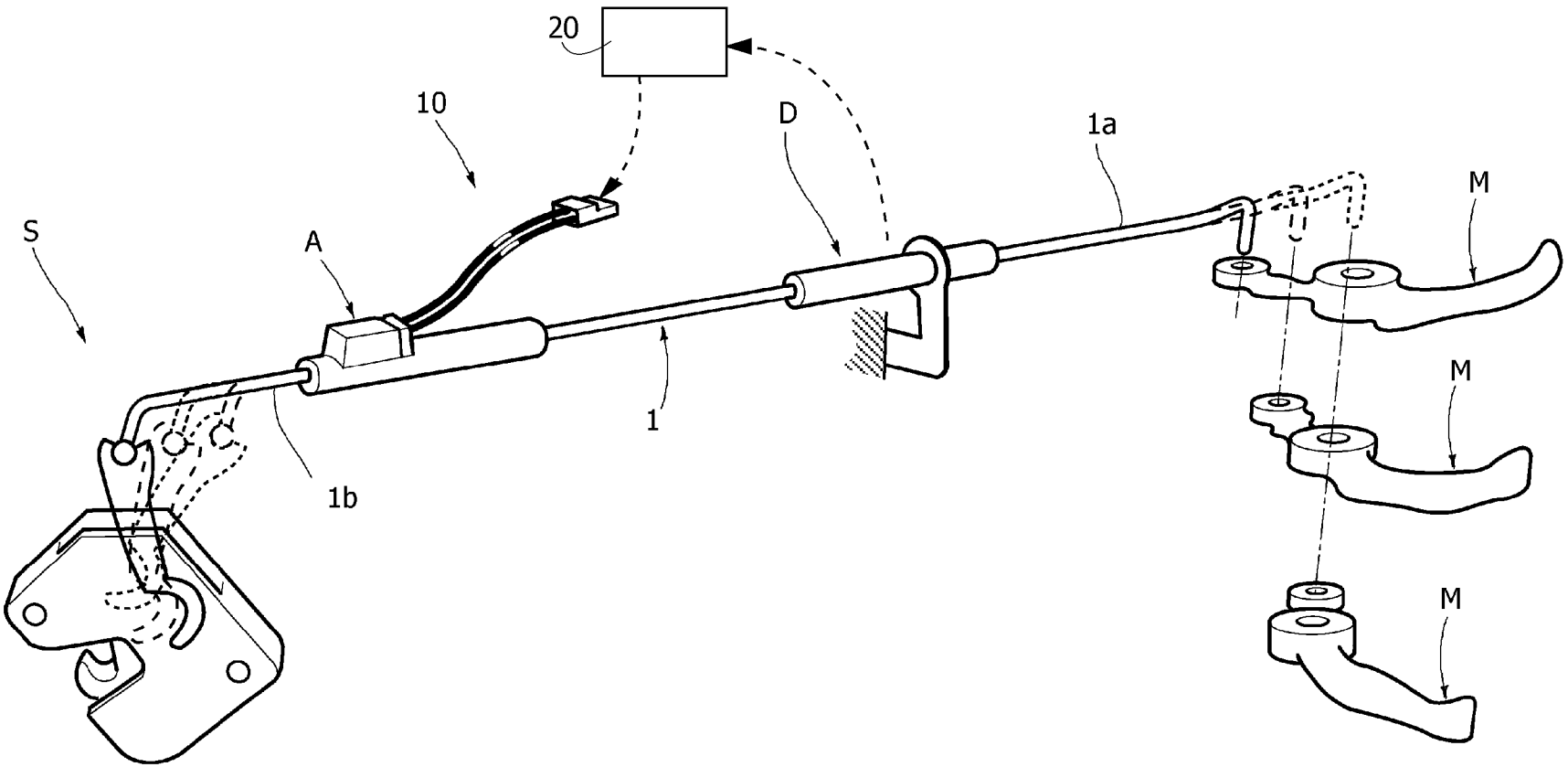
FIG. 1 is a perspective view of the assisted manual actuating device applied to a locking device for motor vehicles showing movement of the locking device from a first position to a second position.
Figure 2:
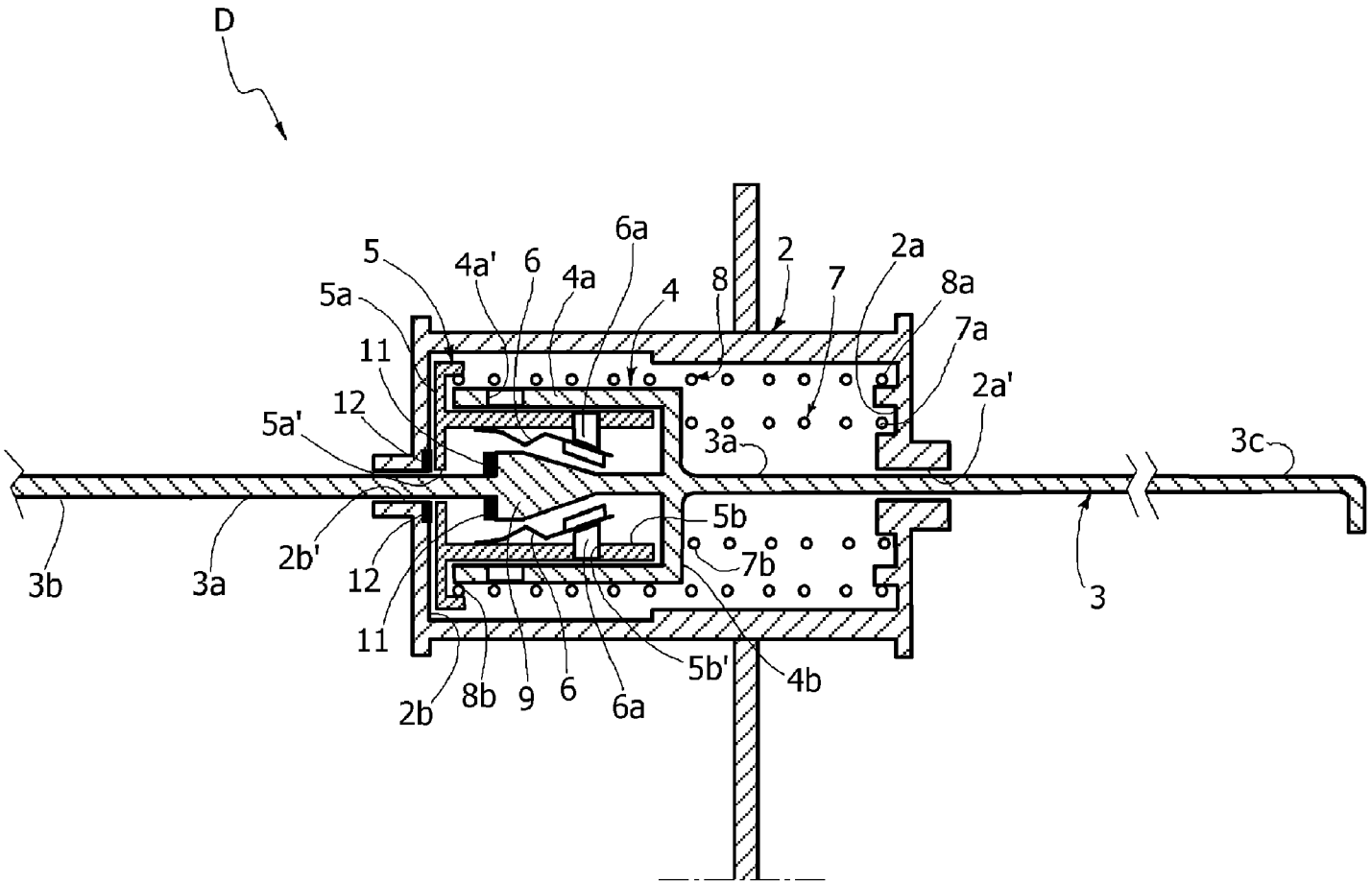
FIG. 2 is a cross-sectional view of the detail D of FIG. 1, in which the actuating device is in the resting position.

In the alternative operating mode, no pulling action is exerted on the device, and it is sufficient to enable supply of electric current through the flexible wire in order to bring about its retraction on account of the shape-memory effect. Said actuator device A is connected to an electrical-supply source (not illustrated) which, in turn, is driven by an electronic control unit 20 (FIG. 2).

Said mechanical transmission 1 further includes an activation device D having a casing 2, which, in turn, has on two opposite faces 2*a*, 2*b* two openings 2*a*', 2*b*' through which the first and second ends 3*c*, 3*b* of a transmission element 3 forming part of the mechanical transmission 1 come out. The first and second ends 3*c*, 3*b* of the transmission element 3 are constituted by a metal wire.

The transmission element 3 has, on the portion contained within the casing 2, two flanges 4 shaped like an L set upside down, which project in a radial direction, diametrally opposite with respect to a main body 3*a* of the transmission element 3. These flanges each have in the portion 4*a* parallel to the main body 3*a* a hole 4*a*' with axis orthogonal to the direction of actuation of the device. The activation device D further comprises a plate 5, formed by a base 5*a* having a central hole 5*a*', through which the main body 3*a* passes and which has two extensions 5*b* orthogonal to said base 5*a*. The dimensions of the plate 5 are such that, when it is installed in the device, its two extensions 5*b* set themselves within the space comprised between the flanges 4 of the transmission element 3, parallel to and in contact with the perforated portions of flange 4*a*. Inserted between the two extensions 5*b* of the plate 5 is a detaining spring 6, fastened to the base 5*a* of the plate 5, and on each of its distal ends a detaining pin 6*a* is present. The detaining pins 6*a* are inserted within respective holes 5*b*' made on each extension 5*b* of the plate 5.

Set inside the casing 2 are two concentric springs 7, 8, each of which has a first end 7*a*, 8*a* that bears upon the internal face of the wall 2*a* that faces the handle side. In addition, the innermost spring 7 has the second end 7*b* bearing upon the two portions 4*b* orthogonal to the main body 3*a* of the L-shaped flanges 4, whilst the outermost spring 8 bears, at its second end 8*b*, upon the base of the plate 5*a*.

The main body 3*a* of the transmission element 3 has, in a position corresponding to the flanges 4, a wedge-shaped part 9, which narrows in the direction of the handle side, the wider section of which has a thickness greater than that of the section of the main body 3*a*. In a position corresponding to the wider section of this conical part, switches 11 are present, which are designed to detect the position of the detaining pins 6*a*. Other switches 12 are arranged on the internal face of the wall 2*b* that faces the side of the actuator device of the fixed structure 2, in the proximity of the hole 2*b*'. Said switches 12 detect the position of the plate 5. Both of the pairs of switches 11, 12 are proximity switches, which, in the case of detection of the presence of the reference element, issue a signal to control unit 20 of the supply source.

In conditions of resting of the actuating device (FIG. 2), the handle M is in a first position. In said position, the plate 5 bears upon the internal face of the wall 2*b* pushed by the outermost spring 8, and the transmission element 3 bears upon the base 5*a* of the plate 5 in a position corresponding to the ends of the portions 4*a* of its flanges 4, pushed by the innermost spring 7. In said arrangement, since the switches 11 do not detect the presence of the detaining pins 6*a*, they maintain the electrical connection between the electrical-supply source and the actuator device A closed.

Figure 3:
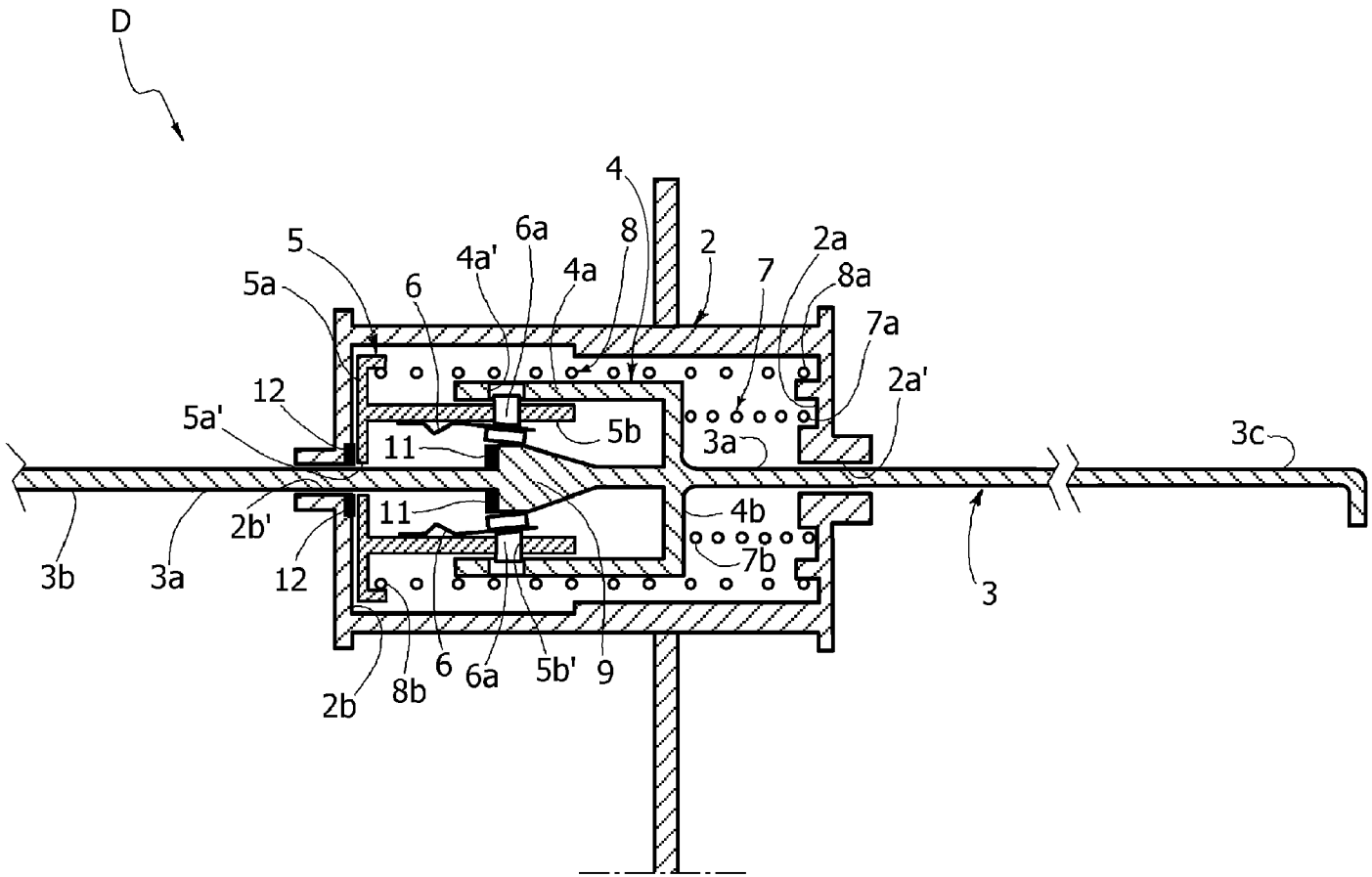
FIG. 3 is a view of the same detail, in which the actuating device is in the actuation position.
Figure 4:
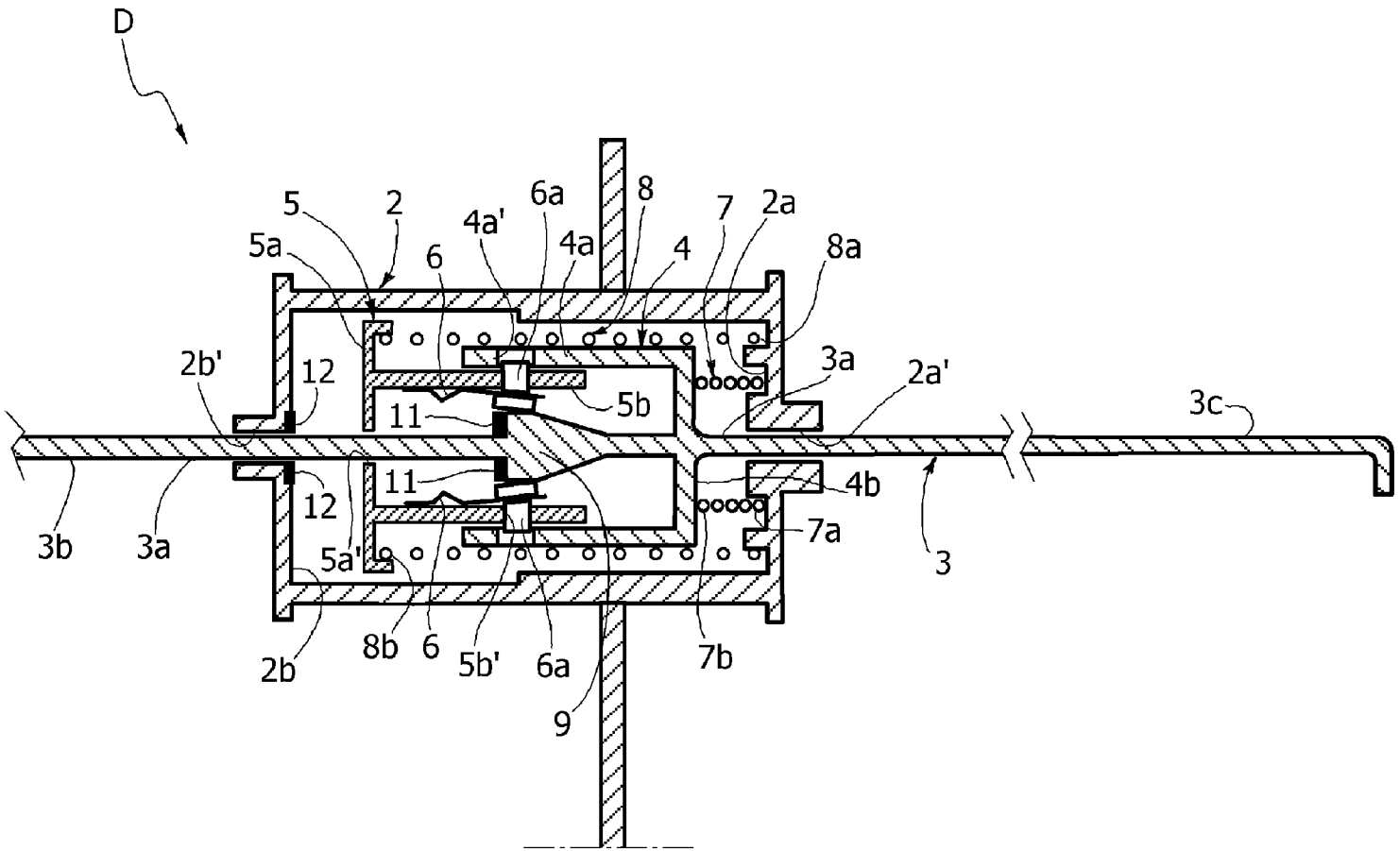
FIG. 4 is a view of the same detail, in which the actuating device has exceeded the aforesaid actuation position.

The user, by exerting a pulling action on the handle, brings the latter into a second position. Said position corresponds to a condition of actuation of the device (FIG. 3).

In fact, the transmission element 3, drawn by the handle M, is displaced until it sets itself in such a way that the holes 4*a*' of its flange portion 4*a* parallel to the main body 3*a* will align with the holes 5*b*' present in the extensions 5*b* of the plate 5. In this way, the detaining pins 6*a* of the detaining spring 6 insert into the aforesaid holes 4*a*' of the flanges 4 of the element 3, pushed into the holes during displacement of the transmission element 3 by the wedge-shaped portion 9 of its main body 3*a*. In said arrangement, the electrical connection between the supply source and the actuator device opens. In this way, the shape-memory element of the actuator device is traversed by current. The shape-memory element, remaining in this position, is heated by the Joule effect and, when a temperature is reached above the austenitic temperature, the martensitic/austenitic transition starts, which causes shortening of the shape-memory element.

Said shortening corresponds to the work of actuation performed by the actuator device, which in this case opens the locking device. As has already been cited previously among the advantages of the present invention, in this case the force that opposes the actuation and tends to approach the end 1*a* to the opposite end 1*b* of the mechanical transmission 1 is countered by the plate 5 that bears upon the wall 2*b* of the casing 2. This force, in the device of the known art, had to be countered by the user.

If the user displaces the handle further in the direction of actuation, bringing it into a third position, this draws along with it the transmission element 3, which in turn draws along with it the plate 5, since this is anchored thereto via the detaining pins 6*a*. In this way, the plate 5 detatches from the internal face of the wall 2*b* of the casing 2, switching the switch 12, which no longer detects the presence of the plate 5. Switching of the switch 12 stops the transmission of the signal to control unit 20, which, in turn, blocks the electrical connection with the actuator device, consequently interrupting the circulation of current within the SMA element. The actuation travel corresponding to the displacement of the handle from the second position to the third position enables mechanical actuation of the device.

Figure 5:
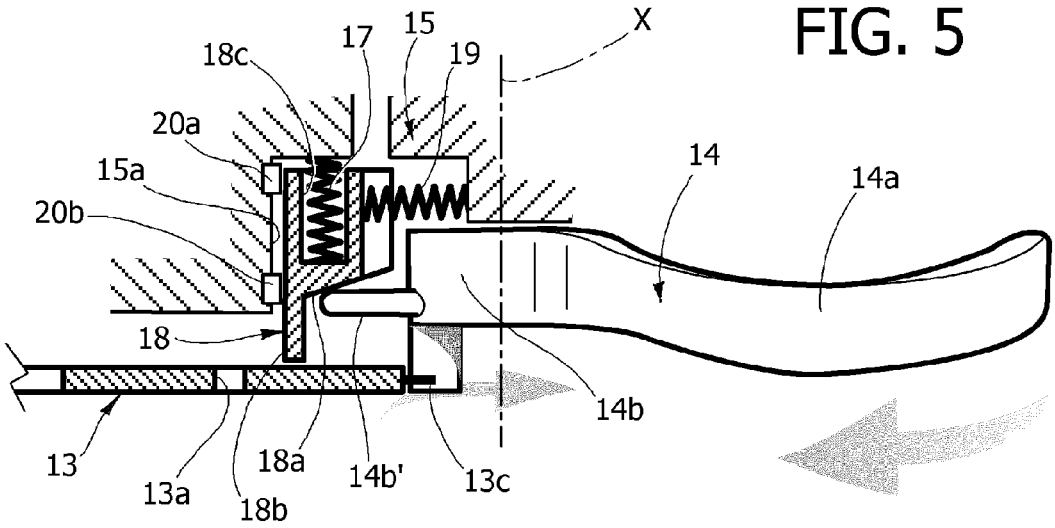
FIGS. 5, 6, and 7 show the aforesaid three conditions in the case of a variant.
Figure 6:
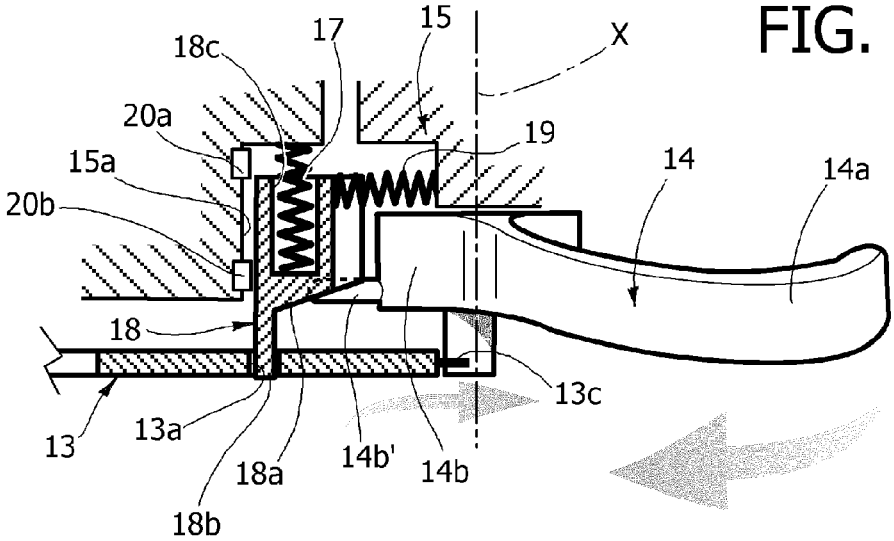
Figure 7:
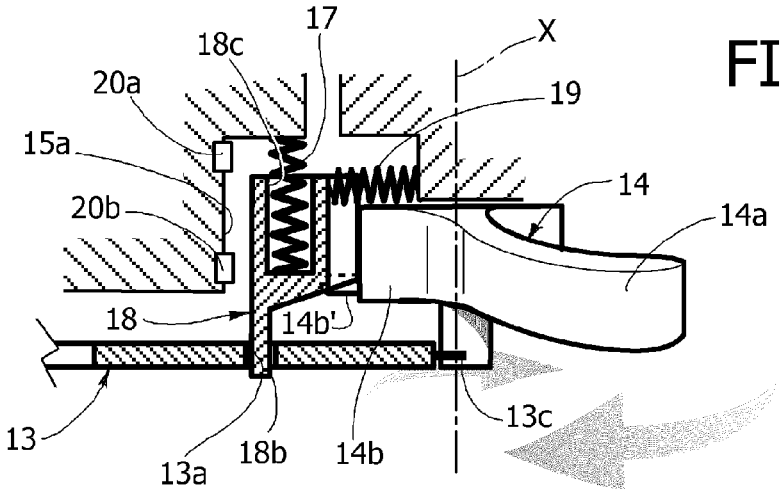

Represented in FIGS. 5 to 7 is a second embodiment of the present invention. In particular, FIG. 5 represents the transmission element 13, connected at one first end 13*c* thereof to a handle 14.

Its end portion connected to the handle has a flattened section in which a hole 13*a* is made. The handle 14, controlled manually by the part thereof that can be gripped 14*a*, is supported in such a way that it can turn about an axis of rotation X by a fixed structure 15, via an articulation pin (not illustrated). In a position corresponding to the cylindrical part 14*b* of the handle 14, which is coupled with the pin of the fixed structure 15, a projection 14*b*' is present, which extends in a radial direction. A detaining element 18 is maintained so that it bears upon said projection 14*b*' via a first spring 17 inserted in a cavity 18*c* of the detaining element 18, orthogonal to the transmission element 13.

The detaining element 18 is in contact with said projection 14*b*' in a position corresponding to an inclined surface 18*a* thereof that faces the side in which the transmission element 13 is located.

The detaining element 18 has, in the direction of the axis of rotation of the handle 14, on the side in which the transmission element 13 is located, a cylindrical projection 18*b* of a width slightly smaller than the width of the hole 13*a* of the transmission element 13.

Via a second spring 19 the detaining element 18 is brought to bear upon a wall 15*a* of the fixed structure 15. Said wall 15*a* has two switches 20*a*, 20*b* set at a distance from one another. Said switches 20*a*, 20*b* are connected to the control unit that controls the electrical-supply source connected to the actuator device. When the handle 14 is in the first position corresponding to a resting condition of the device, the detaining element 18 is in contact with both of the switches 20*a*, 20*b*. Said arrangement corresponds to signals issued to control unit 20 by the two switches such as to keep the electrical connection between the supply source and the actuator device closed.

By turning the handle 14 and bringing it into a second position (FIG. 6) corresponding to a configuration of actuation of the device, the user causes the projection 14*b*' of the cylindrical part 14*b* of the handle 14, by rotating, to slide with respect to the inclined surface 18*a* of the detaining element 18 so as to come into contact with points of said surface that are located above the previous points of contact.

The above mutual sliding leads to lowering of the detaining element 18 such as to switch the switch 20*a*. In this condition, just the switch 20*b* sends an electrical signal to control unit 20 such as to cause opening of the electrical connection between the supply source and the actuator device A. In this way, circulation of electric current is caused within the SMA element of the actuator device A.

By remaining in this position, the SMA element is heated by the Joule effect, and, when a temperature is reached above the austenitic temperature, the martensitic/austenitic transition starts, which causes a shortening of the SMA element. Said shortening corresponds to the work of actuation performed by the device, which, in this case, opens the locking device.

As has already been mentioned previously, one of the advantages of the present invention, in this case, is that the force that opposes actuation and that tends to bring the end 1*a* up to the opposite end 1*b* of the mechanical transmission 1 is countered by the detaining element 18 bearing upon the fixed structure 15. This force, in the device of the known art, had to be countered by the user.

If the user further displaces the handle 14 in the direction of actuation, bringing it into a third position, this draws along with it the transmission element 13, which in turn draws along with it the detaining element 18, this being anchored thereto via the projection 18*b* inserted in the hole 13*a* of the transmission element 13.

The detaining element 18 is thus detached also from the last switch 20*b*, in this way closing the electrical connection and hence blocking circulation of current within the SMA element. The actuation travel corresponding to the displacement of the handle from the second position to the third position enables mechanical actuation of the actuating device.

Of course, instead of the actuator device A shown in the preferred embodiment, a simple wire made of shape-memory material connected to an electrical-supply source can be used, which in turn is driven by a control unit e.g., control unit 20).

It is evident that the actuating device according to the present invention leads to considerable advantages of use in so far as the user can choose to issue a command for the actuating device in an altogether servo-assisted way or else in an altogether mechanical way.

In addition, the device according to the present invention leads to important advantages also from the standpoint of safety. In fact, the device is connected to the electrical-supply source only once the control element has been maneuvered by the user along the first actuation travel. This prevents, in resting conditions, any unforeseeable electrical pulses from activating the actuating device. Considering the various applications also in the automotive field, this safety aspect becomes of fundamental importance.

Of course, without prejudice to the principle of the invention, the details of construction and the embodiments may vary widely with respect to what is described and illustrated herein purely by way of example, without thereby departing from the scope of the present invention.

What is claimed is:

1. An assisted manual actuating device for actuating a controlled member, said controlled member displaceable between a first position and a second position, wherein said first position corresponds to a rest position and said second position corresponds to an actuation position of said controlled member, said device comprising:

a control member designed to actuate said controlled member, said control member being displaceable manually along a first actuation travel to reach the actuation position of the controlled member;

a transmission system connecting said control member to said controlled member, said transmission comprising:

a mechanical element having a first end portion connected to said control member, a middle portion and a second end portion connected to said controlled member;

a shape memory element connected to an end of the middle portion and to an end of the second end portion, said shape memory element moving between a non-shortening position and a shortening position;

a control unit operatively coupled to a switch that is adapted to detect when said control member reaches said actuation position;

electrical-supply means for supplying a current through said shape-memory element to move said shape memory element toward said shortening position, said means activated by said control unit when said control member reaches said actuation position; and an activation device connected to another end of the middle portion and to an end of the first end portion; the activation device having anchoring means for constraining said mechanical transmission when said control member reaches the actuation position in such a way as to enable said transmission system to move only in the direction useful for bringing said controlled member into said second position.

2. The assisted manual actuating device according to claim 1, wherein said control member can be displaced along a second actuation travel, subsequent to the first actuation travel, said second actuation travel being designed to deactivate said electrical-supply means and to bring said controlled member into said second position.

3. The assisted manual actuating device according to claim 1, wherein it is an actuator for a locking device of a motor vehicle.

4. The assisted manual actuating device according to claim 3, wherein said control member is a handle.

5. The assisted manual actuating device according to claim 1, wherein said shape-memory element is a wire made of shape-memory material, said wire being shortened when traversed by the current supplied by said electrical-supply means.

6. The assisted manual actuating device according to claim 1, wherein said activation device comprises a transmission element having at least one hole designed to receive a respective engagement element of said anchoring means.

7. The assisted manual actuating device according to claim 2, wherein said anchoring means is kept so that it bears upon a fixed structure by elastic means in such a way as to enable said anchoring means to move only in the direction of actuation of the actuating device.

8. The assisted manual actuating device according to claim 6, wherein the transmission element comprises two diametrically opposed flanges shaped like an L set upside down, each of which has, in the portion parallel to the main body of the transmission element, a hole with axis orthogonal to the direction of actuation of the actuating device.

9. The assisted manual actuating device according to claim 8, wherein said anchoring means comprises a plate, formed by a base and by two extensions orthogonal to said base, said extensions carrying, through two holes, respective detaining pins forming part of a detaining spring fastened to the base of said plate.

10. The assisted manual actuating device according to claim 9, wherein the main body of the transmission element has a conical part that narrows in the direction of the handle side, said conical part being designed to push said detaining pins of said engagement means within said holes of said flanges of the transmission element, when said transmission element is pulled by the control member.

11. The assisted manual actuating device according to claim 10, wherein said conical part has the wider section with a thickness greater than that of the section of the main body of the transmission element.

12. The assisted manual actuating device according to claim 6, wherein said control member comprises a projection in contact with a cam profile of said anchoring means, said cam profile being such that, when said control member is maneuvered, said projection is displaced with respect to said cam profile consequently causing said anchoring means to be displaced towards said transmission element, in this way causing insertion of said engagement element into said hole of said transmission element.

13. An assisted manual actuating device for actuating a controlled member, said a controlled member displaceable between a first position and a second position, wherein said first position corresponds to a rest position and said second position corresponds to an actuation position of said controlled member, said device comprising:

a control member designed to actuate said controlled member, said control member being displaceable manually along a first actuation travel to reach said actuation position of the controlled member;

a transmission system connecting said control member to said controlled member, said transmission comprising:

a mechanical element having a first end portion connected to said control member, a middle portion and a second end portion connected to said controlled member;

a shape memory element connected to an end of the middle portion and to an end of the second end portion, said shape memory element moving between a non-shortening position and a shortening position;

a control unit operatively coupled to a switch adapted to detect when said control member reaches said actuation position;

electrical-supply means for supplying a current through said shape-memory element to move said shape memory element toward said shortening position, said means being activated by said control unit when said control member reaches said actuation position;

an activation device connected to another end of the middle portion and to an end of the first end portion; the activation device having anchoring means for constraining said mechanical transmission when said control member reaches the actuation position, in such a way as to enable said mechanical transmission to move only in the direction useful for bringing said controlled member into said second position; and wherein said control member is displaceable along a second actuation travel, subsequent to the first actuation travel, said second actuation travel de-activating said electrical-supply means and bringing said controlled member into said second position.

* * * * *